United States Patent [19]

Chow

[11] 4,000,624

[45] Jan. 4, 1977

[54] MULTI-COMPONENT OFFSHORE PLATFORM

[75] Inventor: Philip Y. Chow, Orinda, Calif.

[73] Assignee: Lin Offshore Engineering, Inc., San Francisco, Calif.

[22] Filed: June 10, 1975

[21] Appl. No.: 585,501

[52] U.S. Cl. ..... 61/88; 61/50; 61/89; 61/94; 61/95; 61/100

[51] Int. Cl.[2] ..... L02B 17/00

[58] Field of Search ..... 61/46.5, 46, 50, 63; 114/.5 D, .5 R

[56] References Cited

UNITED STATES PATENTS

| | | | |
|---|---|---|---|
| 2,775,095 | 12/1956 | Harris | 61/46 |
| 2,901,890 | 9/1959 | Hutchinson | 61/46 |
| 2,941,370 | 6/1960 | Walker | 61/46.5 |
| 2,942,424 | 7/1960 | Koble | 61/.5 |
| 3,380,256 | 4/1968 | Rebikoff | 61/46.5 |
| 3,738,113 | 6/1973 | Madary et al. | 61/46.5 |
| 3,811,289 | 5/1974 | Bassett | 61/46 |
| 3,852,969 | 12/1974 | Gibson et al. | 61/46.5 |
| 3,898,847 | 8/1975 | Magnanini | 61/46.5 |
| 3,913,335 | 10/1975 | Heien | 61/46.5 |
| 3,928,982 | 12/1975 | Locroix | 61/46.5 |

FOREIGN PATENTS OR APPLICATIONS

| | | | |
|---|---|---|---|
| 1,156,651 | 7/1969 | United Kingdom | 61/46.5 |

*Primary Examiner*—Paul R. Gilliam
*Assistant Examiner*—A. Grosz
*Attorney, Agent, or Firm*—Owen, Wickersham & Erickson

[57] ABSTRACT

A multi-component offshore platform having a floatable and ballastable central column with a base that is adapted to rest on the bottom of the sea. The column is towed to its site while floating and then upended and ballasted to sink the base to the proper site. A hitch collar is slidably arranged around the central column. At least three inclined legs, which may each be separately floatable for towing to the site and are ballastable for sinking, are hingedly secured to the hitch collar. The collar is then lowered on the central column to a desired height and secured there. The legs then are swung down by ballasting. Each leg has a foot which is hinged to one extremity of its leg for engagement with the ocean floor. The superstructure can then be placed on the top of the central column.

15 Claims, 14 Drawing Figures

MULTI-COMPONENT OFFSHORE PLATFORM

BACKGROUND OF THE INVENTION

This invention relates to a multi-component offshore platform and to a method for erecting the same.

Heretofore, piled steel platforms and concrete gravity platforms have been devised for offshore use. However, as it becomes desirable to locate offshore platforms in still deeper water and in more hostile environments, the piled steel platforms and concrete gravity platforms have been met with severe challenges. At the present time, in the sizes now available, the capabilities of the industry are already being strained to the limit, not only in construction but also in the transportation, launching, and installation of these structures. A tremendous increase in their size will be required as the water depth and the severity of the environmental conditions are further increased. This size increase will not only add considerably to the already tremendous structural cost, but will exceed the existing capabilities in almost every area related to design, construction, and installation of these very large offshore structures.

An object of the present invention is to make it possible to locate offshore platforms in still deeper water and still more severe conditions. The invention employs a system in which the base supporting structure is spread over a much larger area by using components that are attached to each other.

Other objects of the invention include making more feasible and more economical the building of such platforms in deeper water and to make them better able to withstand more severe environmental conditions. Severe conditions such as earthquakes, ice forces, and unusually strong winds and large waves can be withstood better by employing the system of the present invention.

A further object is to accommodate differential settling of some elements with respect to others.

A still further object is to provide a novel interior oil storage structure.

SUMMARY OF THE INVENTION

The invention comprises a multi-component offshore platform. One of these components is a floatable, ballastable central column having a base that is adapted to rest on the bottom of the sea. This column can be floated before it is ballasted and can be towed to its site; then at the site it is upended and ballasted to sink the base down to its final resting place.

The next component is a hitch collar which is slidably arranged around the central column. This collar can be installed either before or after the column is in place, and the collar can be slid downwardly at a suitable time and secured in position at some desired height along the column.

At least three inclined legs are hingedly secured to the hitch collar. Each of these legs is floatable and can be towed to the site. There, one end of each leg is pivotally attached to the collar, and then the collar is lowered along the column by or along with ballasting of the leg ends nearest the collar. Then the outer ends of the legs are ballasted and lowered to the bottom of the sea. The legs then act as a kind of tripod-like structure supporting the central column, and since the collar can be lowered a substantial distance, these legs need not necessarily be even as high as the column itself.

Each of the legs has a foot hinged to one extremity thereof, and the foot is to be secured to the ocean bottom or sea bottom either with or without piles. During the lowering operation, each foot is so ballasted that its base is kept in a more or less horizontal position throughout its descent.

The base of the feet and the base of the central columns may each be keyed and provided with skirts around its periphery, so as to increase its resistance against sliding on the sea floor when it is acted on by a horizontal force. Such gap as remains between each base and the sea bottom after the peripheral skirt has penetrated into the sea bottom is filled with cement grout to provide complete contact with the sea bottom over the full area of the base.

Finally, the superstructure is arranged, placed, or built on top of the central column and supported by it, with the column itself having the additional support provided by what are in effect flying buttresses, namely, the legs.

An important feature of the invention is that each of these components can be prefabricated, towed out to the site, and assembled and installed at the site. The size of the components normally bears a certain ratio to the depth of the sea where it is used. A typical diameter of the central column would be about one-eighth of its height, or the sea depth, and each of the legs may have a diameter equal to about half the diameter of the central column.

Each of these components may be made from various materials including steel, steel and concrete, and concrete. The components may be constructed at a fabricating yard by pour-in-place techniques or by using prefabricated segments which are then connected together, as by post tensioning techniques. Slip forming can be used to advantage if conditions are favorable for it. A horizontal slip-form method can speed up construction at the fabricating yard. Alternately, if a deep water dock is available, vertical slip-forming may be employed, with the constructed portions floating in the water in a vertical position.

The buoyancy and ballasting capabilities enable the components to be towed to the site and, in the instance of the legs, to be hitched to the ring collar before the collar is lowered to its final position below water. Then the thrust block end, that is the feet of the inclined legs, can be lowered to the bottom. Relatively short anchor piles of predetermined lengths may be placed in the thrust block before lowering, and the piles can later be driven in by underwater hammer.

The structural design of the components enables them to withstand very severe loading conditions whether during construction, transportation, launching, installation, and during the operational life of the assembled structure. They withstand sagging and hogging during tow, withstand differential pressures between the ballast compartments and also between the ballast compartments and the atmosphere or the sea outside during both unballasted and ballasted conditions. The central column may be designed to withstand minor storms even before the legs are installed, and, when the structure is completely assembled, it will resist the maximum design conditions, which include 100 year storms, tsunamis, earthquakes, ice forces, and so on.

The central column may be provided with a reservoir at its lower end that is normally ballasted with sea water and with equipment for displacing much or most of the sea water with crude oil, thus providing for storage of a substantial amount of oil at times when delivery is not possible, as in between transfers to tankers. This storage system preferably includes sensors for indicating and controlling the level of oil-water interface for preventing overfilling the reservoir with loss of oil and also for preventing transfer of sea water into the delivery conduit.

Other objects and advantages of the invention will appear from the following description of some preferred forms of the invention.

A BRIEF DESCRIPTION OF THE DRAWINGS

DESCRIPTION OF A PREFERRED EMBODIMENT

Figure 1:
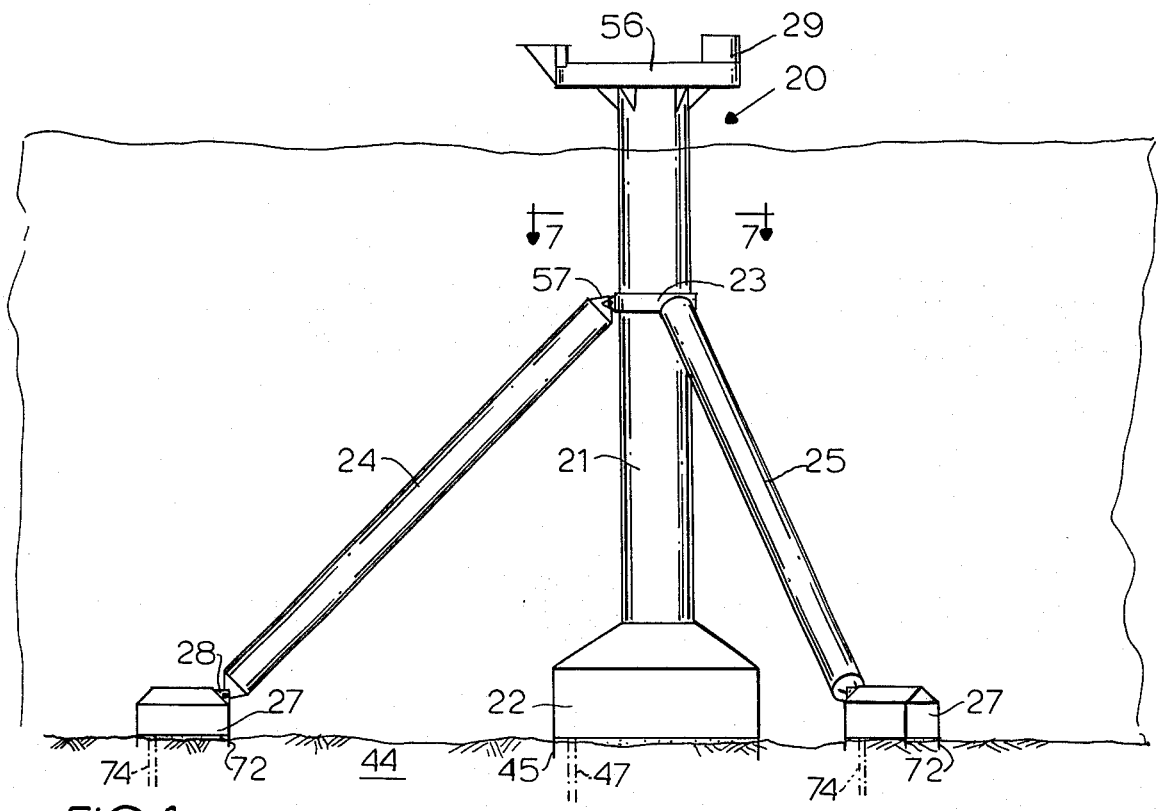
FIG. 1 is a view in side elevation of a multicomponent offshore platform embodying the principles of the invention, installed in position.
Figure 7:
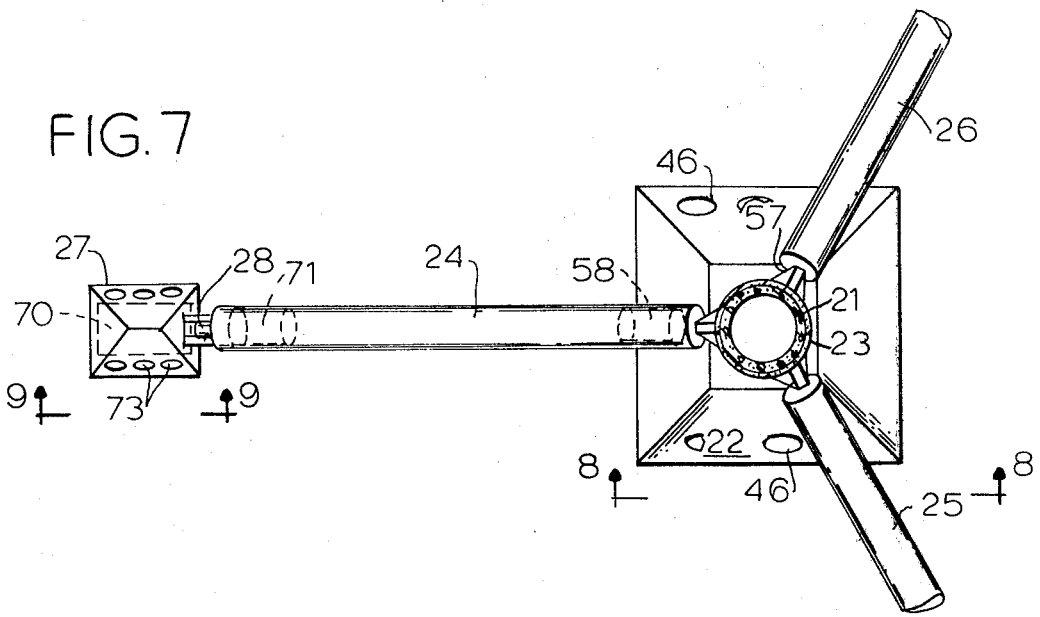
FIG. 7 is a view in section taken along the line 7—7 of FIG. 1, with two of the legs having their extremities broken off in order to conserve space in the drawing.

FIG. 1 shows an example of an offshore platform assembly 20 embodying the principles of the invention. This offshore assembly 20 includes a central column 21 having an enlarged base 22 which may be rectangular or circular or other configuration. Around the outer periphery of the central column 21 is a collar 23 to which are hinged three legs 24, 25, and 26 (the leg 26 shows in FIG. 7 but not in FIG. 1). Each leg 24, 25, 26 has at its lower end a foot 27 which is connected to it by a suitable hinge 28. On top of the central column 21 is a prefabricated deck 29 and the superstructure.

Figure 2:
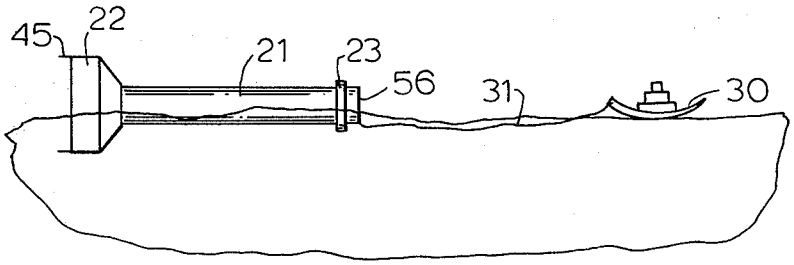
FIG. 2 is a somewhat diagrammatic view of a central column of the invention being towed to its installation site.

In FIG. 2, a central column 21 is shown being towed to its site by a tugboat 30 and a towline 31. The column 21 is hollow, so that it floats, having, for example, ballast chambers 32 and 33 for upending and, preferably, also ballast chambers 34 and 35 for providing full ballast. The actual number of ballast chambers is, of course, a matter of specific demands or desires. Each ballast chamber 32, 33, 34, and 35 (as shown in FIG. 2 only for the ballast chamber 33) is provided with a water inlet 36 having a valve 37, an air inlet 38 having a valve 39 and connected to a conduit 40, and an air outlet 41 having a valve 42 and connected to a duct 42 which preferably leads up to the atmosphere.

Thus, with all the buoyancy chambers 32, 33, 34, and 35 initially empty—that is, filled with air—the valves 37 and 42 in the chambers 32 and 33 may be opened for ballasting. The valve 37, preferably located at what it to become the lower end of its ballast chamber 32 or 33, then admits sea water to the chambers 32 and 33 through the water inlet 36, while air passes out from the chambers 32 and 33 via the open valves 42, which are located near what will become the upper ends of the chambers 32 and 33; the air then flows from the outlet 41 through the duct 43 up to the atmosphere. In this ballasting operation, the valve 39 remains closed. For deballasting, the valve 42 is closed and the valve 39 is opened. Compressed air from a compressor on the tugboat 30 is sent via the conduit 40 down through the air inlet 38 (also located, preferably, near the upper end of each ballast chamber), and water is expelled to a desired amount via the valve 37. The valve 37 may then be closed. It is of course possible to combine the air system by having only one three-way valve perform the functions of the valves 39 and 42 or to have a three-way valve located on the tug and connected by a conduit to one of the valves 39 or 42, the other one being eliminated.

Figure 3:
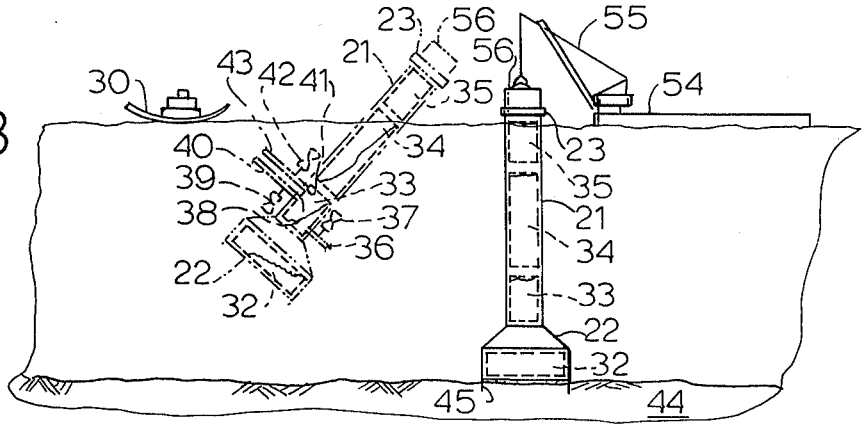
FIG. 3 is a diagrammatic view illustrating the setting in place of the central column, with the column being shown in broken lines during installation and in solid lines in its final position, but partly broken away to show ballasting.

Thus, when the tugboat 30 has brought the central column 21 to the desired location, the central column 21 is, as shown in FIG. 3, ballasted as just described to upend it and to sink until its enlarged base 22 reaches the ocean bottom 44. The column 21 is then, preferably, fully ballasted, as by filling the chambers 34 and 35, thereby causing a skirt 45 on the base 22 to penetrate as far as possible into the sea bottom 44. The tugboat 30 and towline 31 are then disconnected.

Figure 8:
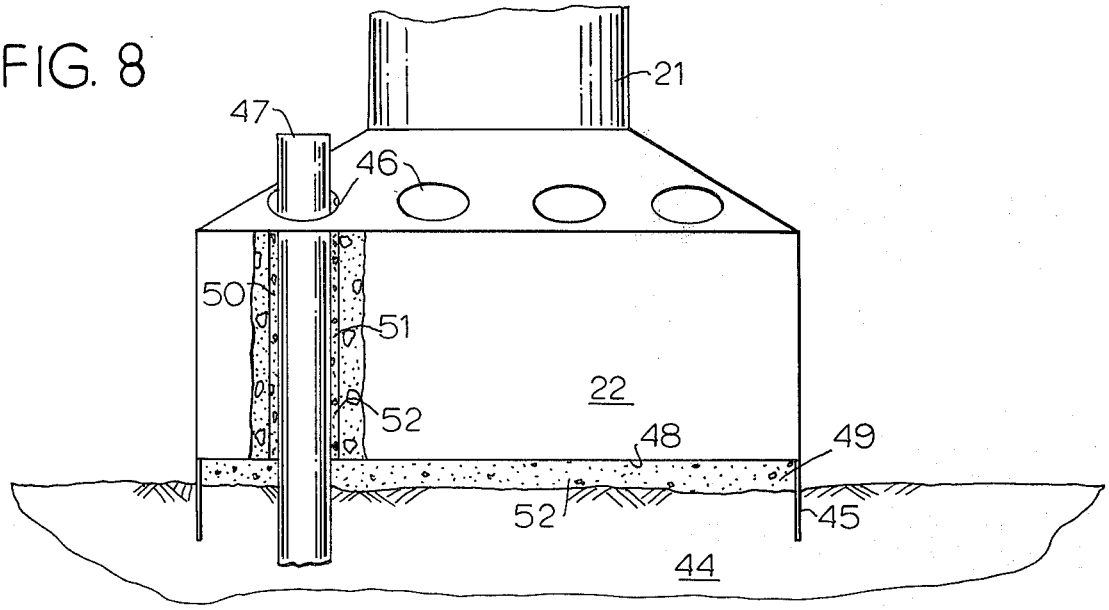
FIG. 8 is a view in elevation with portions broken away of the bottom portion of the column showing some pile receiving openings and piles and a grout passageway. It may be considered as taken along the line 8—8 of FIG. 7.

If piling is necessary, the piling operation is now commenced. As shown in FIG. 8, the enlarged base 22 has a series of openings 46 which lie outside the area occupied by the column 21 proper above the base 22. Piles 47 are inserted through the openings 46 and driven into the sea bottom 44. Since the bottom surface 48 of the base 22 is flat and since the sea bottom 44 is unlikely to be flat, there will be gaps or spaces 49 between the sea bottom 44 and the surface 48 of the base 22 after the piles have been driven; there will also be some annular spaces 50 between the piles 47 and the openings 46. Hence, grout openings 51 are provided from the top of the base 22 to its bottom 48, and cement grout 52 is forced down through the openings 51 to fill the gap 49 and spaces 50 with grout.

A floating crane 54 may be used with its rigging 55 to install winches and accessories that will move the hitching collar 24. This hitching collar 24 may be in place on the column 21 when it is towed, being located then near the upper end 56 thereof or it may be installed after the column 21 has been put in place.

Figure 4:
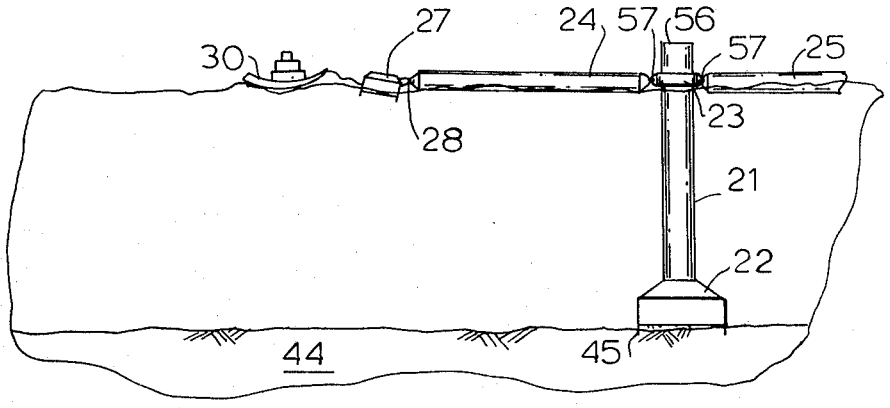
FIG. 4 is a diagrammatic view showing the legs being attached to the collar that is attached to the central column, after the legs having been towed, while floating, to the site and aligned radially.
Figure 5:
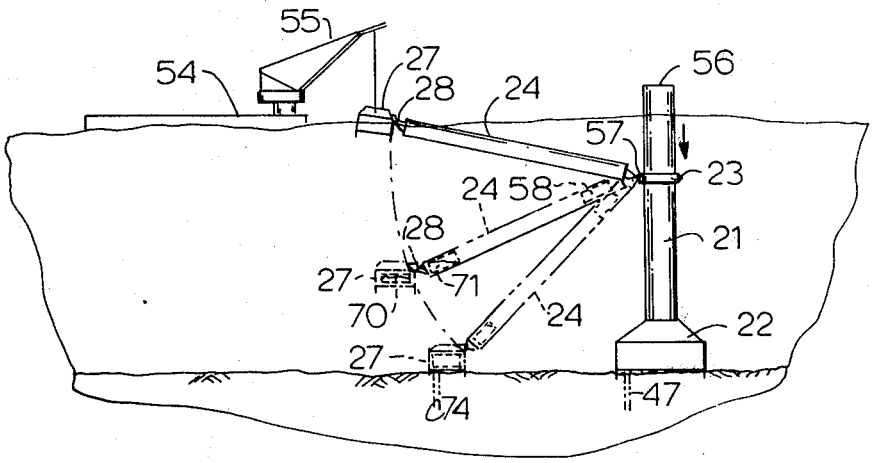
FIG. 5 is a diagrammatic view illustrating the lowering of one of the legs into position, after the hitch collar has been lowered to its final position. Three positions of the leg are shown.

As shown in FIG. 4, each of the legs 24, 25, 26 is towed to the site, as by a tugboat 30. The legs 24, 25, and 26 are hollow and float easily at this step. Once at the site, they are first positioned radially with respect to the central column 21 and are then hitched by a hinge device 57 to the collar 23. A preferred hinge device will be described below. After hitching, these three legs 24, 25, and 26 are maintained in their outwardly radiating position by three tugs 30, which are at all times of this stage tied to the outer ends of the legs 24, 25, and 26. Then the collar 23 is lowered down the column to the position as shown in FIG. 5. This may be done partly by ballasting a ballast chamber 58 (basically like the ballast chamber 33 and similarly provided with valves, etc.) at the inner ends of the legs 24, 25, 26.

When the collar 23 reaches its final vertical position (see FIG. 10), it is secured in place to the central column 21. For this purpose the central column 21 may have an outer shell portion 60 with a recessed or smaller-diameter cylindrical surface 61 terminating at a ledge 62. The collar 23 includes an inner ring 63 having a cylindrical inner surface 64 enough larger in diameter than the surface 61 to enable free vertical sliding. The collar 23 may have three generally trapezoidal portions 65, each of which is provided with a pair of grout passages 66 that lead vertically downward and then near a lower end 67 of the collar lead radially inwardly through the inner ring 63. Thereby, cement grout 68 is forced down through the openings 66 and flows up to fill the space 69 between the surfaces 61 and 64, thereby locking the collar 23 permanently in place.

Figure 9:
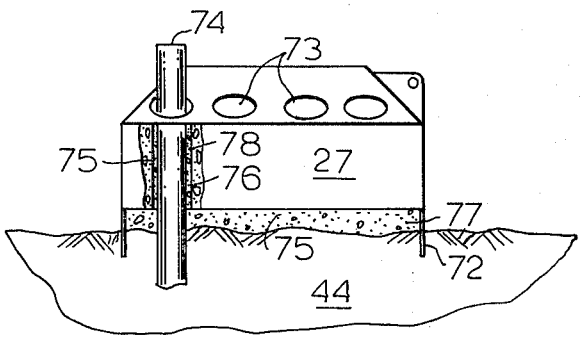
FIG. 9 is a similar view of one of the feet where piles are used. It may be considered as taken along the line 9—9 of FIG. 7.

With the collar 23 secured in place, the foot 27 of each leg 24, 25, 26 may be hooked to the barge crane 54, and then the foot 27 and outer end of each of the legs 24, 25, 26 may be ballasted by letting water into a ballast chamber 70 in each foot 27 and a ballast chamber 71 in the outer end of each leg 24, 25, 26. Ballasting achieves a predetermined negative buoyancy, so that the feet 27 can be lowered easily to the bottom by the crane 54. The legs 24, 25, 26 and their feet 27 are then fully ballasted, so as to sink a peripheral skirt 72 around each foot as far as possible into the sea bottom 44. The feet or thrust blocks 27 may be secured in place by piling and grouting, if necessary. In some instances, it is not necessary, and in others it is. When piling is to be done, the feet 27 are, as shown in FIG. 9, provided with pile-receiving openings 73, and piles 74 are inserted through these openings and driven down into the sea bottom. As in the case of the central column base 22, cement grout 75 is then forced in through passages 76 to fill any gaps 77 between the bottom of the foot 27 and the sea bottom 44 and also to fill the annular spaces 78 between the piles 74 and the passages 73. Once the footings are all in place, the top hinge 57 where the leg 24, 25, or 26 joins the collar 23 is wedged into position, as will be described below.

Figure 6:
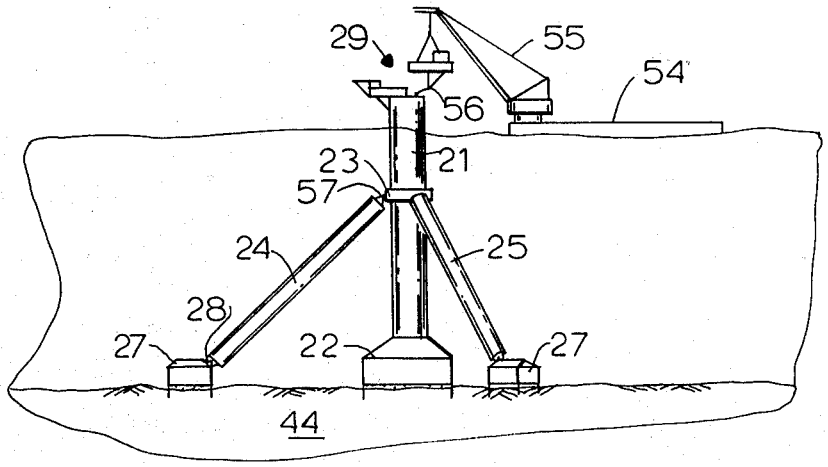
FIG. 6 is a diagrammatic view after the completion of the column-collar-leg assembly, with a prefabricated platform deck being placed on top of the central column.

Finally, as shown in FIG. 6, the prefabricated platform deck 29 is placed on top of the central column 21 by the floating crane 54.

Figure 10:
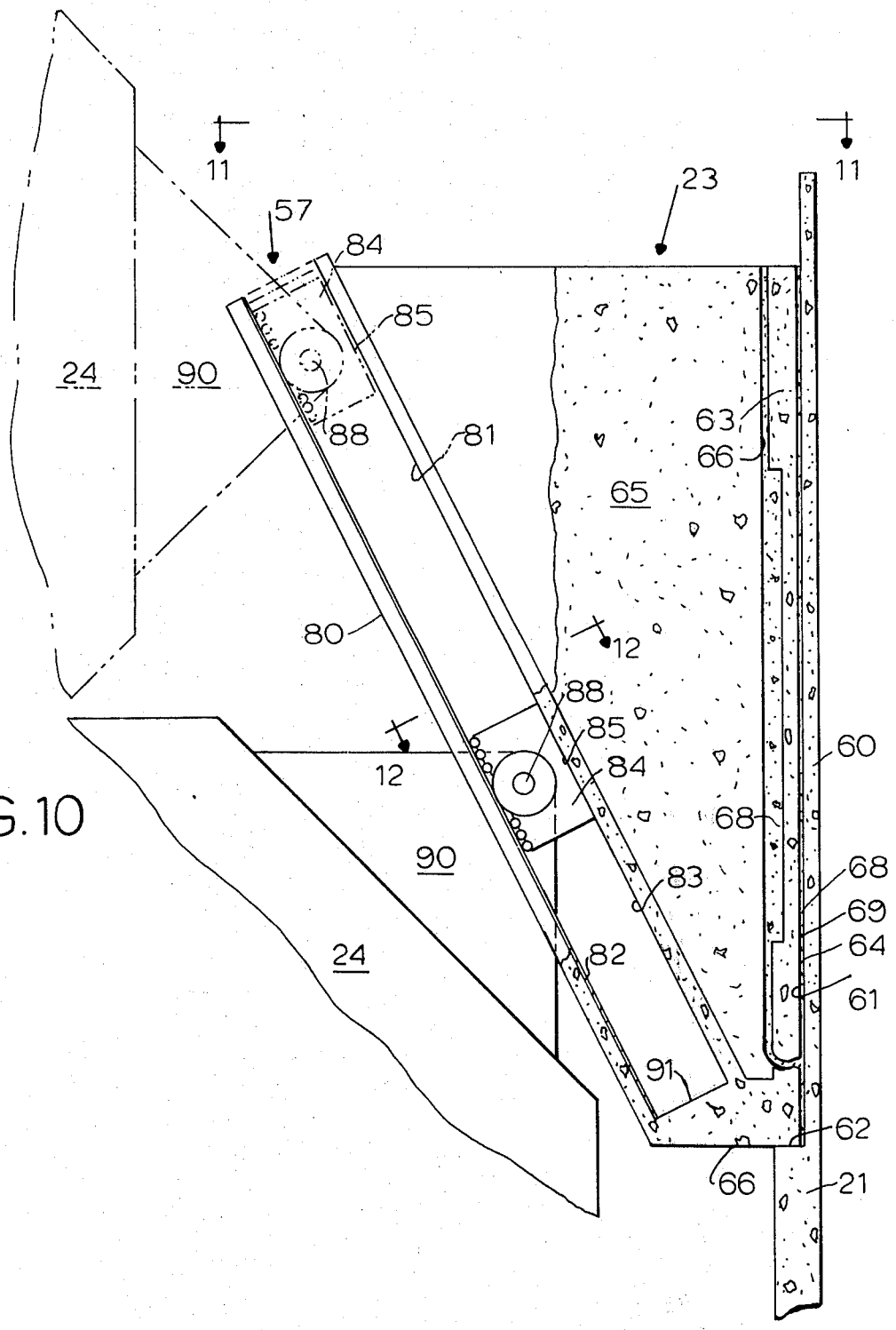
FIG. 10 is a fragmentary view in elevation and in section of the collar and its adjacent parts, including the hitch connection, taken along the section 10—10 of FIG. 11.
Figure 11:
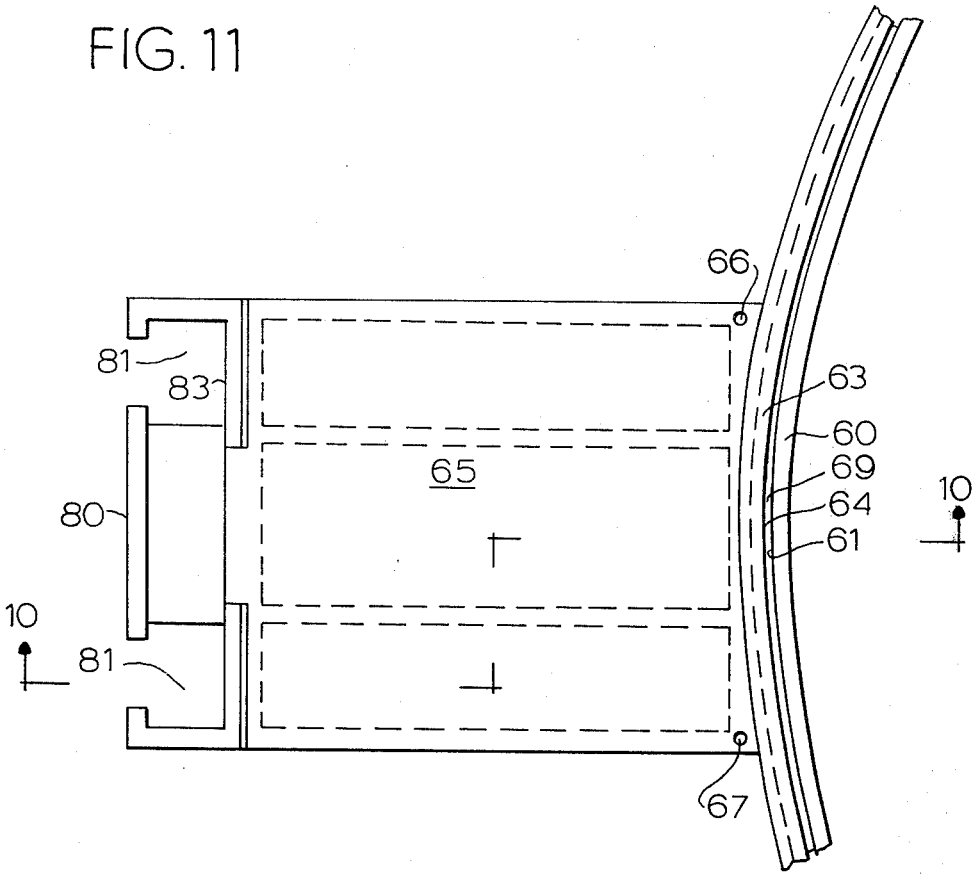
FIG. 11 is a fragmentary plan view taken along the line 11—11 in FIG. 10.
Figure 12:
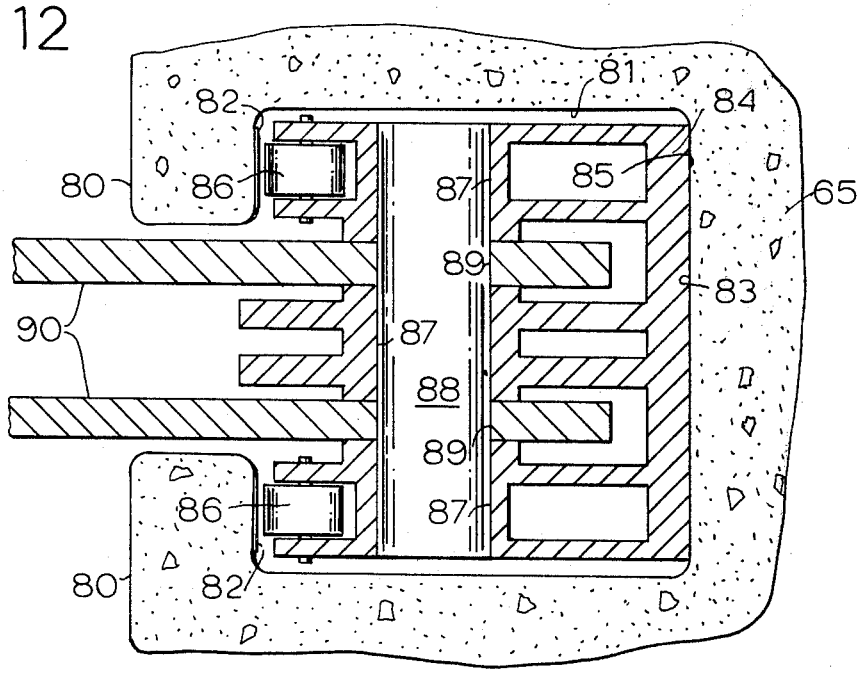
FIG. 12 is a view in section taken along the line 12—12 in FIG. 10.

When the feet 27 are not to be secured in place by piling, then a special hitch design, shown in FIGS. 10–12, may be employed to enable differential settling. In this design, the collar 23 has secured to it three extensions 65 which are trapezoidal as viewed in elevation and rectangular as viewed in plane. Each extension 65 may be hollow, as indicated in FIG. 9, and at its outer, inclined edge 80 it is provided with a pair of identical guide channels 81.

Within each guide channel 81 is mounted a stainless steel liner 82 to provide a smooth surface, but one side 83 of the guide channel 81 is roughened or grooved to provide a friction surface. Within each guide channel 81 is a hinge bearing block 84 which has a friction surface 85 on its face adjacent the friction surface 83 and carries rollers 86 on its opposite face to facilitate downward movement when its leg 24, 25, or 26 is in tension.

The hinge block 84 has openings 87 that receive rotatably a hinge pin 88, and a similar opening 89 in each of a pair of hinge leaves 90 also enable rotation relative to the pin 88. The hinge leaves 90 are secured to the leg 24, the axis 91 of which is shown in FIG. 10.

Each leg 24, 25, and 26 is, as noted earlier, horizontal when it is attached to the hinge assembly 57, and the leg 24 is so shown in FIG. 10 in broken lines. The hinge block 84 is kept in its upper, broken line position by friction between the surfaces 83 and 85. When the leg 24 is ballasted at its foot 27 and its outer end (i.e., when the ballast chambers 70 and 71 are partially filled with water and the leg is sunk), the friction surface 85 of the hinge block 84 is pulled away from the friction surface 83 of the channel 81, and the rollers 86 engage the stainless steel liners 82; hence the hinge blocks 84 begin to roll down the channels 81. The position of the collar 23 on the ledge 62, the length of the leg 24, and the depth of the ocean floor 44 eventually determine the position of the hinge block 84 somewhere above the lower end 91 of the guide channel 81 (see FIG. 10). This determined position is reached when the foot 27 rests firmly on the ocean floor 44. Then, the surfaces 85 and 83 engage and prevent further movement of the block 84.

However, the floor 44 may not be rock hard, and all of the legs 24, 25, and 26 may settle thereafter. Possibly, they may not all three settle evenly; one may settle more than another. The structure just described accommodates such differential settling without placing push or pull on the central column 21, up to a designed margin of safety.

Figure 13:
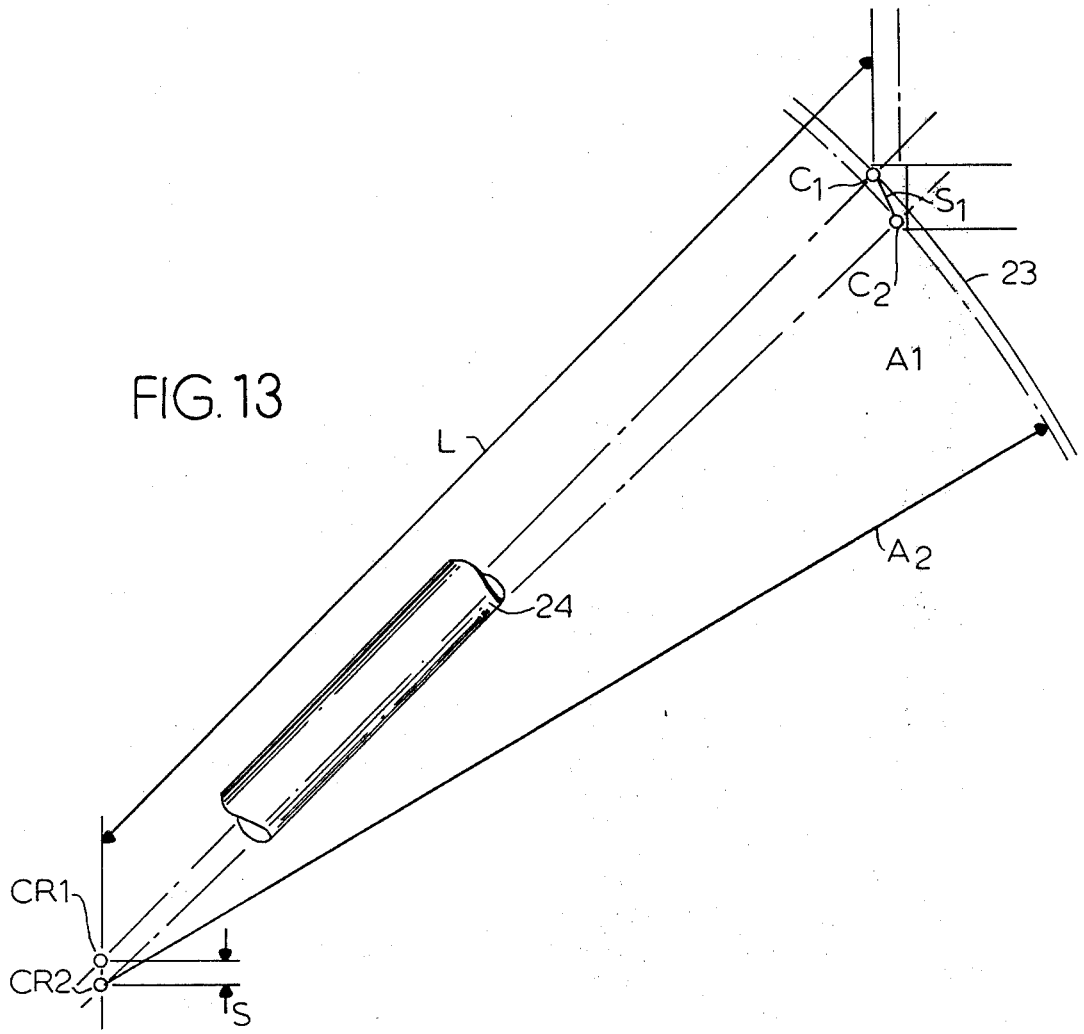
FIG. 13 is a diagram showing what happens when one of the legs settles relative to the column.

Now consider FIG. 13, where the margin of safety is S. Let CR1 be the position of the lower hinge 28 before settlement takes place, and let CR2 be the position of the lower hinge 28 after settlement. C1 represents the center of the top hinge 57 (i.e. the center of the pin 88) before settlement, and L represents the length of the leg 24 between the points CR1 and C1. A1 is the arc of the length L with CR1 as a center.

When the leg 24 settles to the position CR2, then the length L would result in an arc A2. The arc A2 will pull the rough friction surface 85 away from the surface 83, and the block 84 can then move down the channel 81 on its rollers 86 for a short distance, limited by the arc A2. For when the center of the top hinge 57 reaches the position C2, the weight of the block or shoe 84 and the leg 24 wedge the surface 85 once more against the surface 83, and secure the connection once more. The distance S1 sets the limit to the amount of the settlement. The process may continue over a long time and, unless the maximum designed differential settlement S is exceeded, the differential settlement is accommodated.

Figure 14:
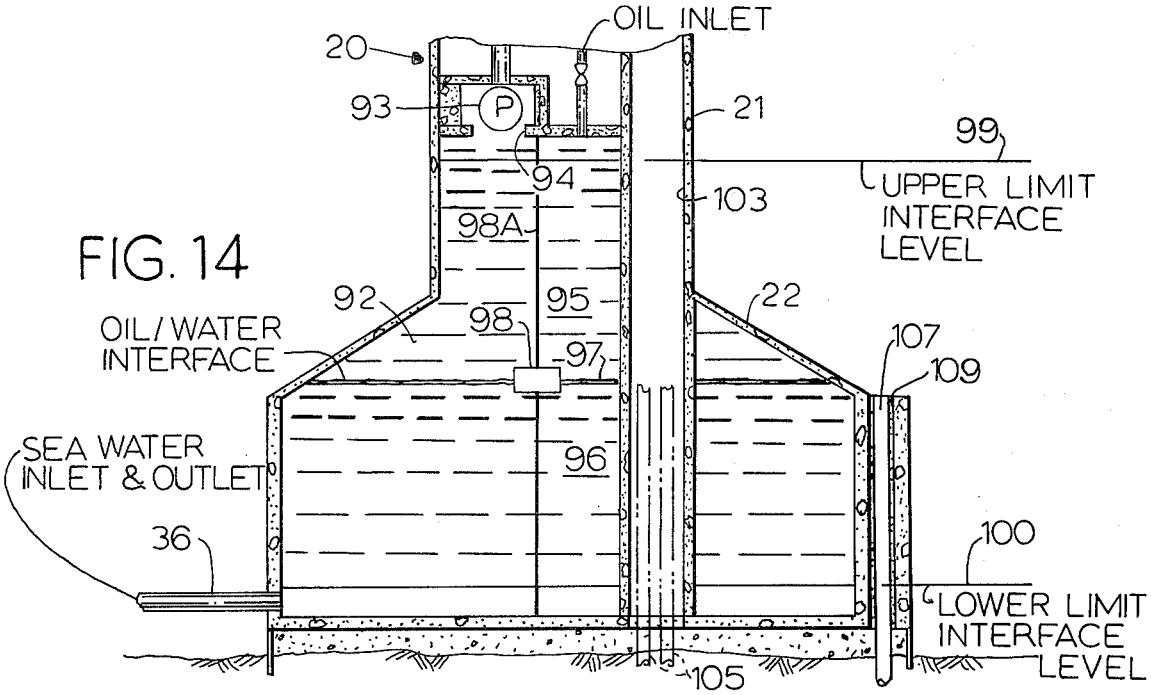
FIG. 14 is a rather diagrammatic view of a bottom portion of a central column incorporating an oil storage reservoir.

Another feature of the invention is shown in FIG. 14. The offshore platform assembly 20 is usually used in drilling for oil, and in that event, the column 21 may have a reservoir 92 that doubles as a ballast chamber and as an oil reservoir. Here, the base 22 may be mostly hollow with an opening 36 near its lower end for expelling and admitting sea water. A deep well pump 93 has an inlet 94 for oil to be pumped out of the reservoir 92, as to a tanker ship. The oil 95 will always float on the water 96, the oil and water meeting at an interface 97. A float type level sensor 98 floats on the interface 97 and rides up and down a guide member 98A; this sensor 98 is set to be actuated at an upper limit 99, when oil 95 is nearly exhausted from the reservoir and the pump 93 is automatically shut down before it begins to carry up sea water 96. When oil is pumped into the reservoir 92 through the inlet 94, the interface 97 will be lowered. At a lower level 100 of the interface 97, reached when the reservoir 92 is almost full, the float level sensor 98 is set to be actuated, and the pump 93 is shut off before it delivers more oil, and thereby expels oil into the ocean through the opening 36. The top of the reservoir 92 may be located practically anywhere along the central column 21, and a very large storage capacity is possible there.

As also illustrated in FIG. 14, the column 21 has a concrete enclosure 103 within the column and base for one or more conductor pipes 105 (shown in phantom outline in FIG. 14) to go through the base 22. The conductor pipe 105 is a steel casing for the drill string, which fans out in any direction once it gets below the foundation. The number of conductor pipes 105 in a platform may vary from a few to 50 or 60, depending on the desired field coverage.

As further illustrated in FIG. 14, one side of the column base 22 may include pilings 107 secured within a sidewall of the column base 22 by grout 109, should this be required.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A multi-component offshore platform, including in combination:

an inherently self-floatable central column having an enlarged base adapted to rest on the bottom of the sea and having ballast chambers with water inlet means, some of said chambers being close to said base and others distant therefrom, said central column being towed to its site while floating generally horizontally and then upended by ballasting said chambers that are close to said base and then further ballasted by filling chambers distant from said base to sink its base to a final resting site on the bottom of the sea, a hitch collar slidably arranged around said central column with means for securing it immovably to said column at a desired location on said column, well above said base and well below the top of said column, at least three inclined legs that are each separately self-floatable for towing to the site and ballastable for sinking, each said leg having a foot member hinged to one extremity thereof, for resting on the bottom of the sea, each said leg being detachably hingedly connected at its other extremity to said hitch collar, and superstructure secured atop said column and supported solely by said column, said column, in turn, being partly supported to said legs wherein said hitch collar has a plurality of extensions, one for each said leg, each having guide channel means extending upwardly at an angle to said central column, and wherein said hinged connection includes a hinge block slideably mounted in each said guide channel with hinge means rotatably attached thereto and secured to said leg.

2. The multi-component offshore platform of claim 1 wherein said enlarged base has a portion extending radially out beyond the periphery of said column and provided with pile-receiving openings for driving piles into the bottom of the sea.

3. The multi-component offshore platform of claim 2 wherein said base portion also has grout-receiving passages wherein grout is injected to fill spaces in said openings around said piles and also to fill gaps between the bottom of the sea and the bottom of said base.

4. The multi-component offshore platform of claim 2 wherein said base has a projecting peripheral skirt that, when said base is emplaced, goes down into said bottom of the sea.

5. The multi-component offshore platform of claim 1 wherein said hitch collar is provided with an upper end and an inner periphery, grout-receiving passages leading downwardly from said upper end and inwardly through the inner periphery for injecting grout to serve as said means for securing said collar immovably to said column.

6. The multi-component offshore platform of claim 1 wherein each said foot is generally frusto-pyramidal and has generally vertical through openings through its side walls to receive piles for vertically driving the piles into the bottom of the sea.

7. The multi-component offshore platform of claim 6 wherein each said foot has a depending peripheral skirt all around its periphery that penetrates the bottom of the sea when the foot is placed, said foot also having through vertical passages for injecting grout into the area defined by the skirt to fill gaps between the foot and the bottom of the sea and also up into the through openings in the space around the pile.

8. The multi-component offshore platform of claim 1 wherein said central column has a diameter of about one-eighth its length, and each leg has about half the diameter of said column.

9. The multi-component offshore platform of claim 1 wherein a lower portion of said column provides an oil storage reservoir, normally filled with sea water, having a closed bottom wall and an opening near its lower end for expulsion and admission of sea water, pump means adjacent its upper end for supplying oil under pressure to and for withdrawing it from said reservoir, an interface float sensor for detecting the level of the oil-water interface and means responsive to said sensor for stopping said pump means at both an upper limit and a lower limit.

10. A multi-component offshore platform, including in combination:

a floatable ballastable central column having a base adapted to rest on the bottom of the sea and ballast means, said central column being towed to its site while floating and then upended and ballasted to sink its base to its final resting site, a hitch collar slidably arranged around said central column with means for securing it in place at a desired location on said column, at least three inclined legs that are each separately floatable for towing to the site and ballastable for sinking, each said leg having a foot hinged to one extremity thereof and hingedly connected at its other extremity to said hitch collar, and superstructure secured atop said column, said hitch collar having a plurality of extensions, one for each said leg, each having guide channel means extending upwardly at an angle thereto, each hinged connection of a said leg to said hitch collar including a hinge block slidably mounted in each said guide channel with hinge means rotatably attached thereto and secured to said leg, each said guide channel having a roughened friction surface and an opposite smooth surface and said guide block having a roughened friction surface facing the friction surface of said channel and roller means facing said smooth surface, said block being smaller than said channel and being normally urged by said leg, due to its length and the distance to the bottom of the sea, into a position where the two said roughened friction surfaces are wedged against each other, but, when leg tension pulls the roughened friction surface of said hinge block away from that of said channel, then said roller means engage said smooth surface and said hinge block can move down in said channel, as to follow differential settling of said legs.

11. A method for constructing an offshore platform, comprising the steps of:

floating in a generally horizontal attitude and directly in the water a floatable ballastable central column having a base and being taller than the sea depth of the site of installation, said column having a series of ballast chambers, some close to said base and some distant therefrom, towing said central column to a site, upending said central column by filling its ballast chambers that lie close to said base and then ballasting the other chambers of said central column to sink its base to a final resting site on the bottom of the sea, floating directly in the water at least three inclined self-floatable legs ballastable for sinking, towing said legs to the site, providing said central column with a slidable hitch collar having a plurality of extensions, one for each said leg, each extension having guide channel means extending upwardly at an angle to said central column hingedly connecting each said leg to said hitch collar, wherein the hinged connection includes a hinge block slidably mounted in each said guide channel with hinge means rotatably rotatably attached thereto and secured to a said leg, attaching each said leg to said collar, each said leg having a foot hinged to the extremity thereof distant from said hitch collar, ballasting the ends of the legs nearer said collar to sink them while sliding the collar down said column, securing said collar in place at a desired location on said column, well above the bottom of the sea and well above the top of said column, ballasting the ends of the legs nearer said foot to lower said foot to the sea floor, securing said feet in place at the bottom of the sea, and erecting a superstructure solely on said column above the water.

12. The method of claim 11 wherein after said upending step, there is a step of driving piles through openings in said base at the lower end of said column.

13. The method of claim 12 wherein cement grout is forced beneath the bottom of said central column to fill gaps between the bottom of said central column and the sea floor and also between said piles and said openings.

14. The method of claim 12 wherein said step of securing said feet in place comprises driving piles vertically through openings in said feet into the floor of the sea.

15. The method of claim 14 wherein cement grout is forced beneath the bottom of each foot to fill up gaps between said foot and the sea floor and also space around said piles in said openings.

* * * * *

UNITED STATES PATENT AND TRADEMARK OFFICE

CERTIFICATE OF CORRECTION

PATENT NO. : 4,000,624

DATED : January 4, 1977

INVENTOR(S) : Philip Y. Chow

It is certified that error appears in the above-identified patent and that said Letters Patent are hereby corrected as shown below:

Column 8, line 8, which is line 28 of claim 1, "supported to said legs" should read --supported by said legs--.

Column 10, line 18, which is line 30 of claim 11, "nearer said collar" should read --near said collar--.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*